US012806538B2

(12) United States Patent
Kamiyama

(10) Patent No.: US 12,806,538 B2
(45) Date of Patent: Nov. 24, 2026

(54) COMBINED CLIMBING TOY AND TOY SLIDE FOR TOY HOUSE, AND TOY HOUSE

(71) Applicant: EPOCH COMPANY, LTD., Tokyo (JP)

(72) Inventor: Kei Kamiyama, Tokyo (JP)

(73) Assignee: EPOCH COMPANY, LTD., Tokyo (JP)

( * ) Notice: Subject to any disclaimer, the term of this patent is extended or adjusted under 35 U.S.C. 154(b) by 281 days.

(21) Appl. No.: 18/792,822

(22) Filed: Aug. 2, 2024

(65) Prior Publication Data

US 2025/0041743 A1 Feb. 6, 2025

(30) Foreign Application Priority Data

Aug. 4, 2023 (JP) ..... 2023-127445

(51) Int. Cl.
*A63H 3/52* (2022.01)

(52) U.S. Cl.
CPC ..... *A63H 3/52* (2013.01)

(58) Field of Classification Search
CPC ..... A63H 3/52; A63H 33/044
USPC ..... 446/71, 476, 478, 479, 487
See application file for complete search history.

(56) References Cited

U.S. PATENT DOCUMENTS 212,050 A * 2/1879 Phillips ..... E06C 1/32 182/27
1,168,978 A * 1/1916 Thomas ..... A63H 11/04 446/315
1,206,760 A * 11/1916 Harris ..... A63H 3/52 446/109
2,312,148 A * 2/1943 Cederquist ..... E06C 1/005 182/27
2,620,185 A * 12/1952 Harding ..... A63G 21/00 D21/818
4,087,932 A * 5/1978 Rosenthal ..... A63H 3/50 446/315
4,755,159 A * 7/1988 Templeton ..... A63H 33/00 446/478
4,813,663 A * 3/1989 Rice ..... A63G 21/02 182/48
5,197,924 A * 3/1993 Gerrells ..... A63H 33/00 446/168
5,980,352 A * 11/1999 Rigberg ..... B65D 81/368 446/73
9,308,460 B1 * 4/2016 Chin ..... A63G 21/04
D986,441 S * 5/2023 Hu ..... D25/64
D1,078,907 S * 6/2025 Kamiyama ..... D21/671
(Continued)

FOREIGN PATENT DOCUMENTS

JP S59-022198 U 2/1984

*Primary Examiner* — Kurt Fernstrom
(74) *Attorney, Agent, or Firm* — Faegre Drinker Biddle & Reath LLP

(57) ABSTRACT

A combined climbing toy and toy slide for a toy house includes: a first member including a first climbing surface and a climbing surface for slide, the climbing surface constituting an opposite surface to the first climbing surface; and a second member including a second climbing surface and a slide surface, the slide surface constituting an opposite surface to the second climbing surface. The second member is rotatably connected to the first member via a hinge portion such that the first climbing surface and the second climbing surface are connectable.

5 Claims, 7 Drawing Sheets

(56) References Cited

U.S. PATENT DOCUMENTS

| | | | | |
|---|---|---|---|---|
| 2015/0056888 | A1* | 2/2015 | Pfiester | A63H 3/52 446/476 |
| 2018/0178134 | A1* | 6/2018 | Nelson | A63G 31/00 |
| 2023/0241523 | A1* | 8/2023 | Kamiyama | A63H 3/52 446/476 |

* cited by examiner

COMBINED CLIMBING TOY AND TOY SLIDE FOR TOY HOUSE, AND TOY HOUSE

CROSS-REFERENCE TO RELATED APPLICATIONS

This application is based on and claims priority under 35 USC 119 from Japanese Patent Application No. 2023-127445 filed on Aug. 4, 2023, the contents of which are incorporated herein by reference.

TECHNICAL FIELD

The present disclosure relates to a combined climbing toy and toy slide for a toy house, and a toy house.

BACKGROUND ART

In the related art, a climbing toy such as stairs and a ladder attached to a toy house used for doll play or the like is known. For example, JPS59-022198U discloses a climbing toy for a toy house enabling not only simple straight stairs but also various stairs such as zigzag and spiral stairs to be assembled by connecting upper and lower surfaces of a plurality of step members formed in a substantially disk shape to be freely rotatable at an eccentric position.

SUMMARY OF INVENTION

The climbing toy of the related art can be enjoyable while changing a shape of the stairs, but in some cases, the play can be more enjoyable if the shape can be changed to enable different play. For example, since a slide is familiar playground equipment for children, the doll play can be more enjoyable if a shape of a toy slide can be changed.

An object of the present disclosure is to provide a combined climbing toy and toy slide for a toy house, which can transform a climbing toy into a toy slide, and a toy house.

A combined climbing toy and toy slide for a toy house according to an aspect of the present disclosure includes: a first member including a first climbing surface and a climbing surface for slide, the climbing surface constituting an opposite surface to the first climbing surface; and a second member including a second climbing surface and a slide surface, the slide surface constituting an opposite surface to the second climbing surface, the second member being rotatably connected to the first member via a hinge portion such that the first climbing surface and the second climbing surface are connectable.

A toy house according to an aspect of the present disclosure includes: the combined climbing toy and toy slide for the toy house; a toy house body having an open front side, the toy house body including a floor member that is detachable, the floor member constituting an upper layer stair including at least a second-floor portion; and a base member, in which the combined climbing toy and toy slide for the toy house is formed such that the first member is configured to engage the floor member and the second member is configured to contact the base member.

According to the above aspects, it is possible to provide a combined climbing toy and toy slide for a toy house, which can transform a climbing toy into a toy slide, and a toy house.

BRIEF DESCRIPTION OF DRAWINGS

The present disclosure will be described in detail based on the following without being limited thereto, wherein.

DESCRIPTION OF EMBODIMENTS

Embodiments of the present disclosure will be described with reference to the drawings. A toy house 1 shown in FIG. 1 has a front (front surface) side that is open, and is formed to imitate a two-story house. The toy house 1 has a toy house body 10 imitating a house, a plate-shaped base member 100, and an accessory toy 200 as a combined climbing toy and toy slide for a toy house. Note that, in the following description, when the toy house 1 is viewed from the front, the left side is referred to as left, the right side is referred to as right, the upper side is referred to as upper, the lower side is referred to as lower, the front side is referred to as front, and the opposite side is referred to as rear.

Figure 1:
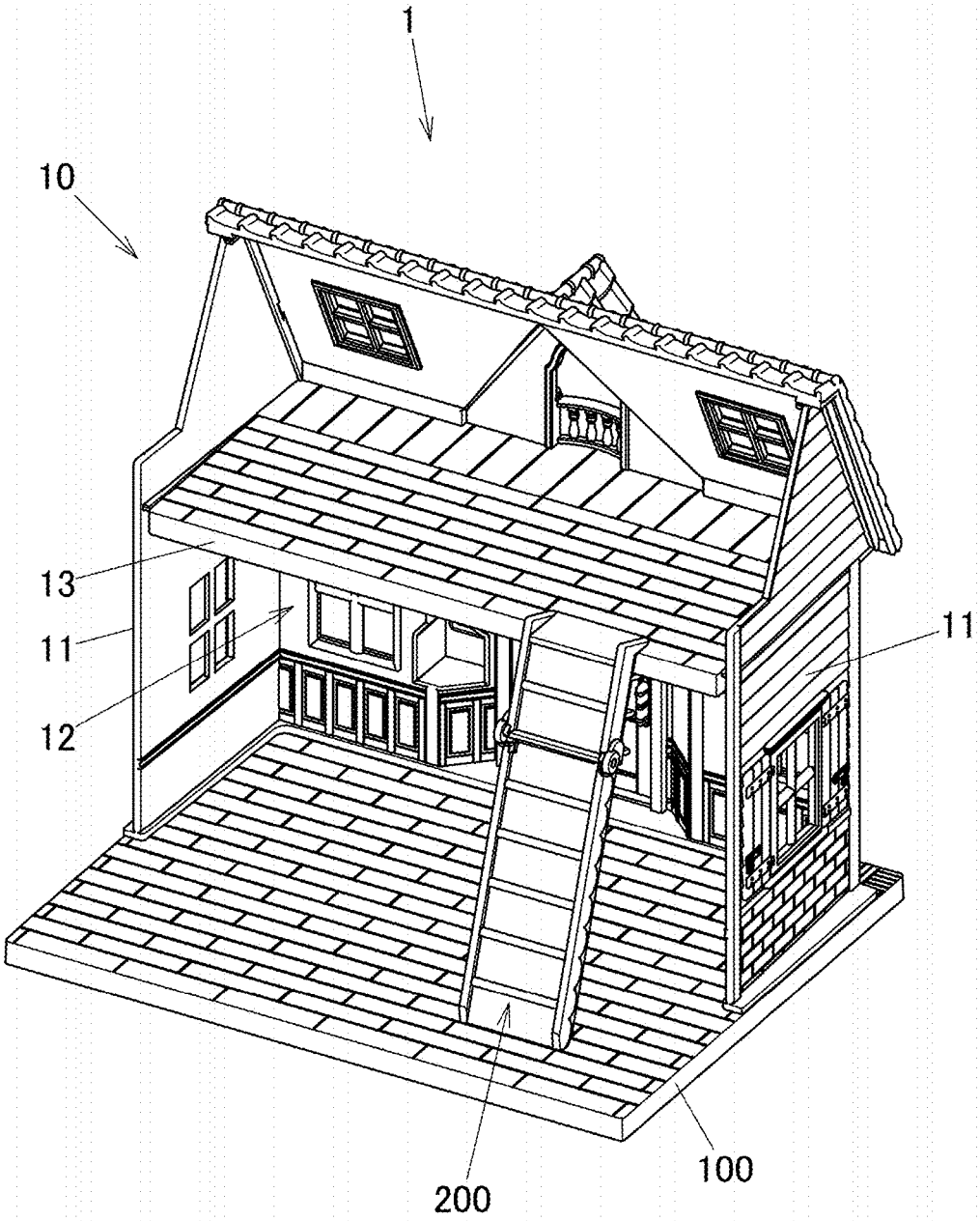
FIG. 1 is a perspective view of a toy house according to an embodiment of the present disclosure.

The toy house body 10 includes plate-shaped wall portions 11 provided to face each other left and right, and a plate-shaped connecting wall portion 12 provided to connect rear sides of the two wall portions 11. The toy house body 10 includes a floor member 13 constituting a second-floor portion. In addition, a part of the roof is formed on the rear side of the second-floor portion. The toy house body 10 includes an accessory toy 200 attached to the toy house 1, spanning the base member 100, which constitutes a first-floor portion, and the floor member 13, and formed to imitate a ladder for going up and down between the first and second floors. The accessory toy 200, which will be described in detail below, can be played as a climbing toy like a ladder as shown in FIG. 1, or can be bent and played as a toy slide (see FIG. 6).

Figure 2:
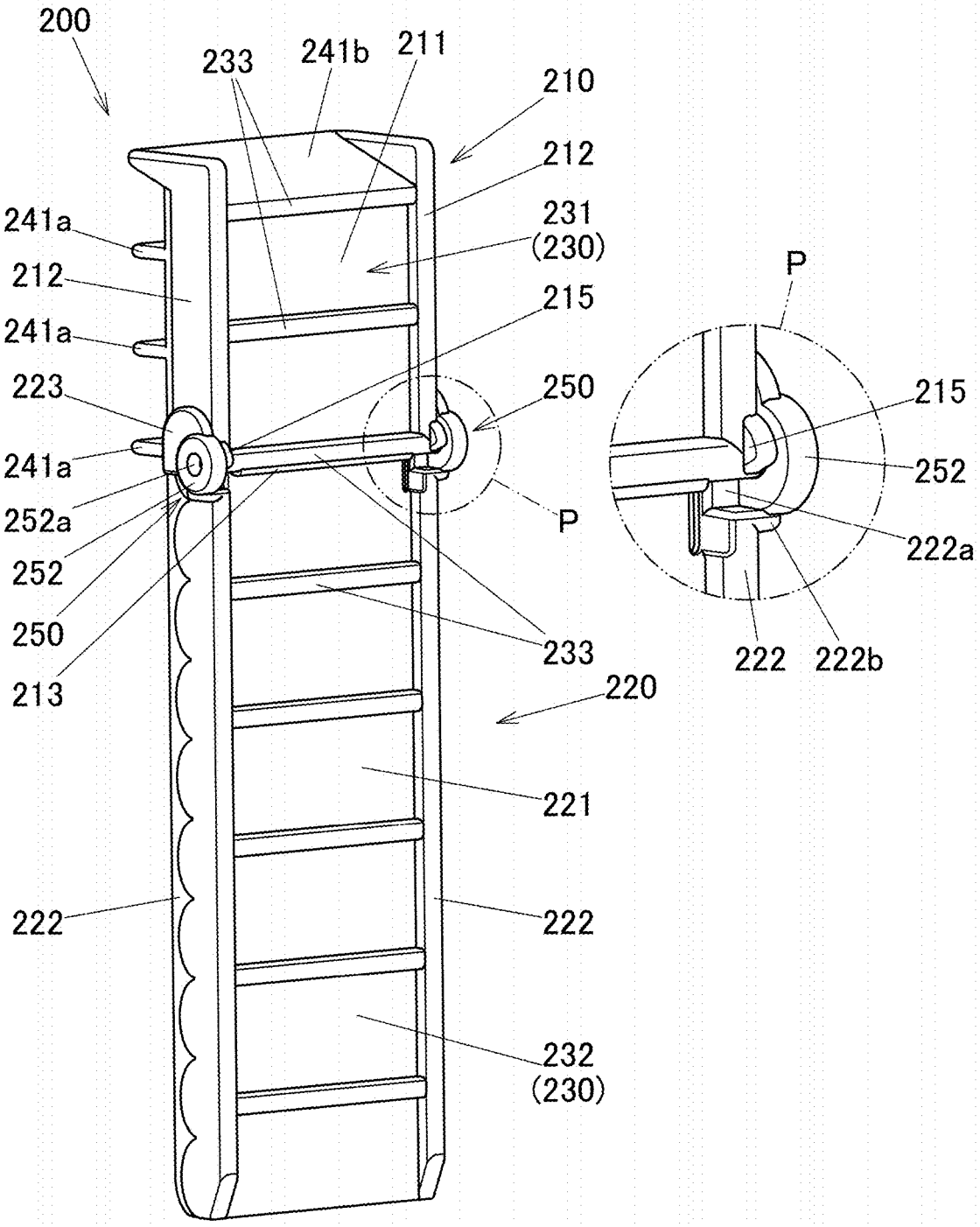
FIG. 2 is a perspective view showing a state in which a combined climbing toy and toy slide for a toy house according to an embodiment of the present disclosure is used as a climbing toy.

As shown in FIG. 2, the accessory toy 200, which is a combined climbing toy and toy slide for a toy house, includes a first member 210 and a second member 220 connected to the first member 210 via a hinge portion 250. The first member 210 and the second member 220 can be bent by the hinge portion 250. The first member 210 and the second member 220 can be transformed into a toy ladder by extension, and can be transformed into a toy slide by bending. The second member 220 is provided longer than the first member 210. The first member 210 and the second member 220 include main plate members 211 and 221 having a substantially long rectangular plate shape and two side plates 212 and 222 provided facing each other at both end portions in a width direction of the main plate members 211 and 221, respectively. The two side plates 212 are symmetrically formed in a left-right direction, and the two side plates 222 are symmetrically formed in the left-right direction. A distance between the two side plates 212 and a distance between the two side plates 222 are approximately the same.

Figure 3:
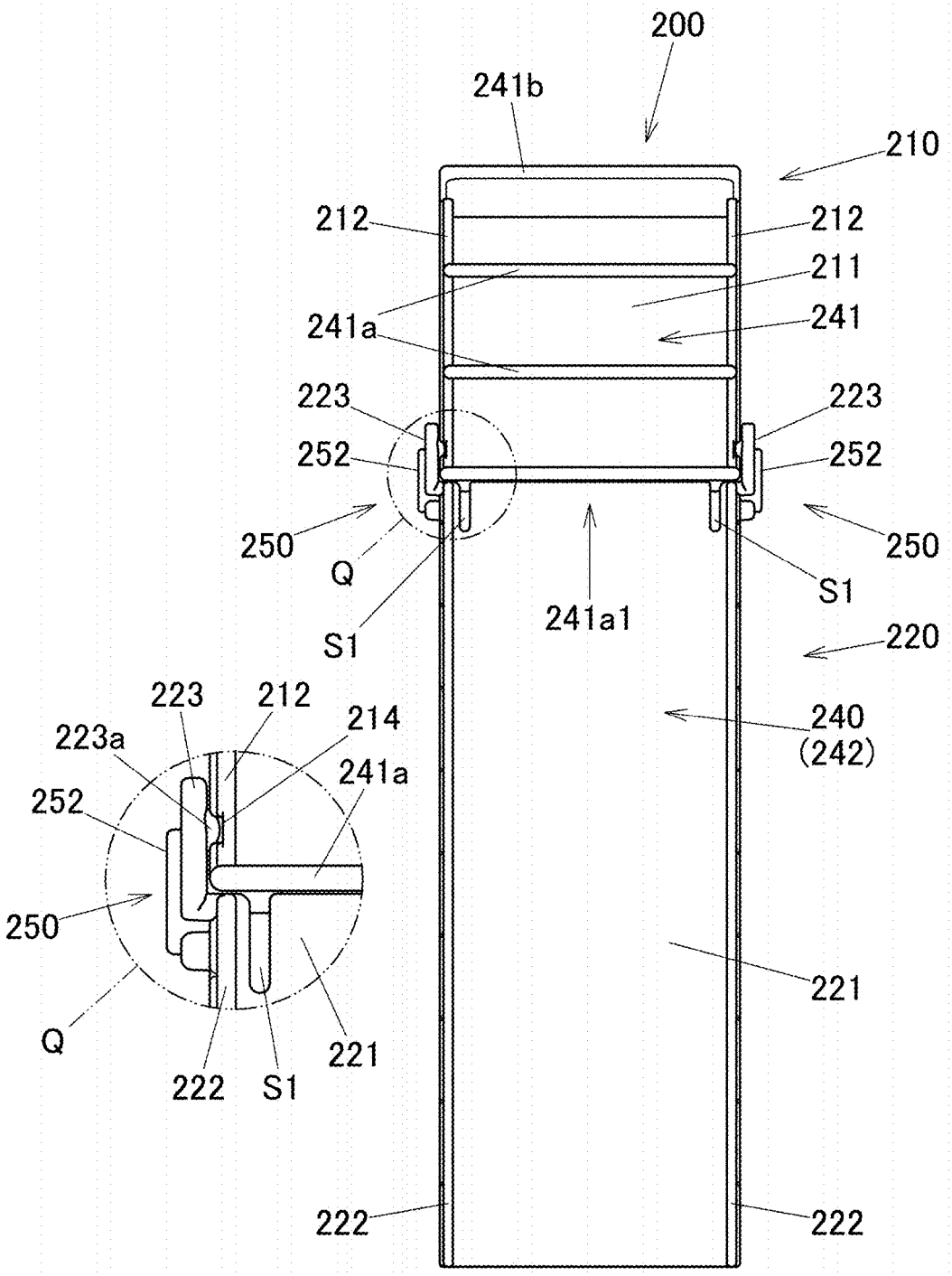
FIG. 3 is a view showing a state in which the combined climbing toy and toy slide for a toy house according to the embodiment of the present disclosure is used as the climbing toy, as viewed from a slide surface.

One surface (a surface shown in FIG. 2) of each of the main plate members 211 and 221 is a climbing surface 230. The other surface of each of the main plate members 211 and 221 is a slide surface 240 (see FIG. 3). The slide surface 240 constitutes an opposite surface to the climbing surface 230. In other words, the climbing surface 230 and the slide surface 240 configure a pair of surfaces. The climbing surface 230 is provided with a plurality of projections 233 extending between the side plates 212 and between the side plates 222 and protruding from the main plate members 211 and 221, imitating rod-shaped steps of a ladder. The climbing surface 230 of the accessory toy 200 is a surface used when the accessory toy is extended in a straight line form as shown in FIGS. 2 and 3. On the other hand, the slide surface 240 of the accessory toy 200 is a surface used when the accessory toy is bent and is played as a toy slide, as shown in FIG. 7.

Figure 4:
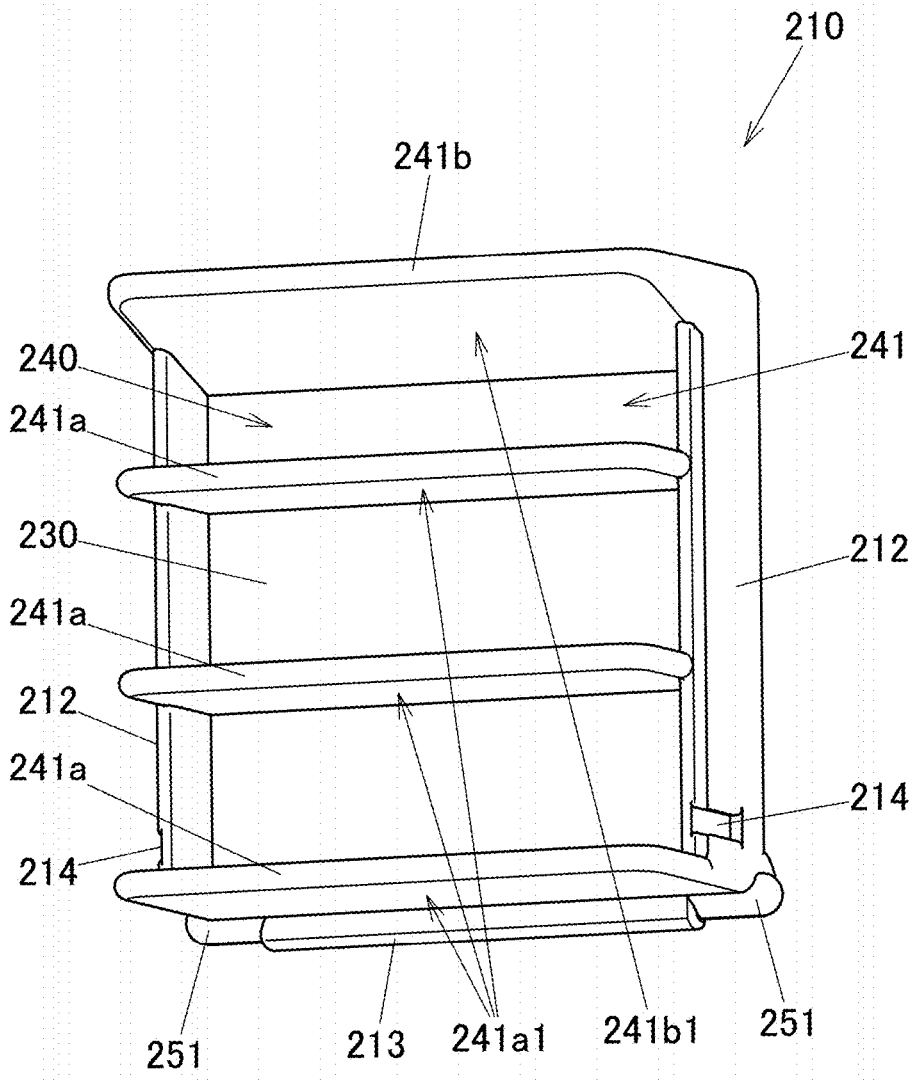
FIG. 4 is a perspective view of a first member of the combined climbing toy and toy slide for a toy house according to the embodiment of the present disclosure.

As shown in FIG. 2, the climbing surface 230 of the first member 210 is a first climbing surface 231. As shown in FIGS. 3 and 4, the slide surface 240 of the first member 210 is a climbing surface 241 for a slide. The climbing surface 241 for a slide has a plurality of (four in the present embodiment) lateral plates 241*a* and 241*b* provided between the two side plates 212. In this way, the climbing surface 241 for a slide is formed in a step stair shape. Note that, as shown in FIG. 6, when using the accessory toy 200 as a slide, lower surfaces of the lateral plates 241*a* and 241*b* in FIG. 4 serve as step surfaces 241*a*1 and 241*b*1 as stepping surfaces.

Figure 6:
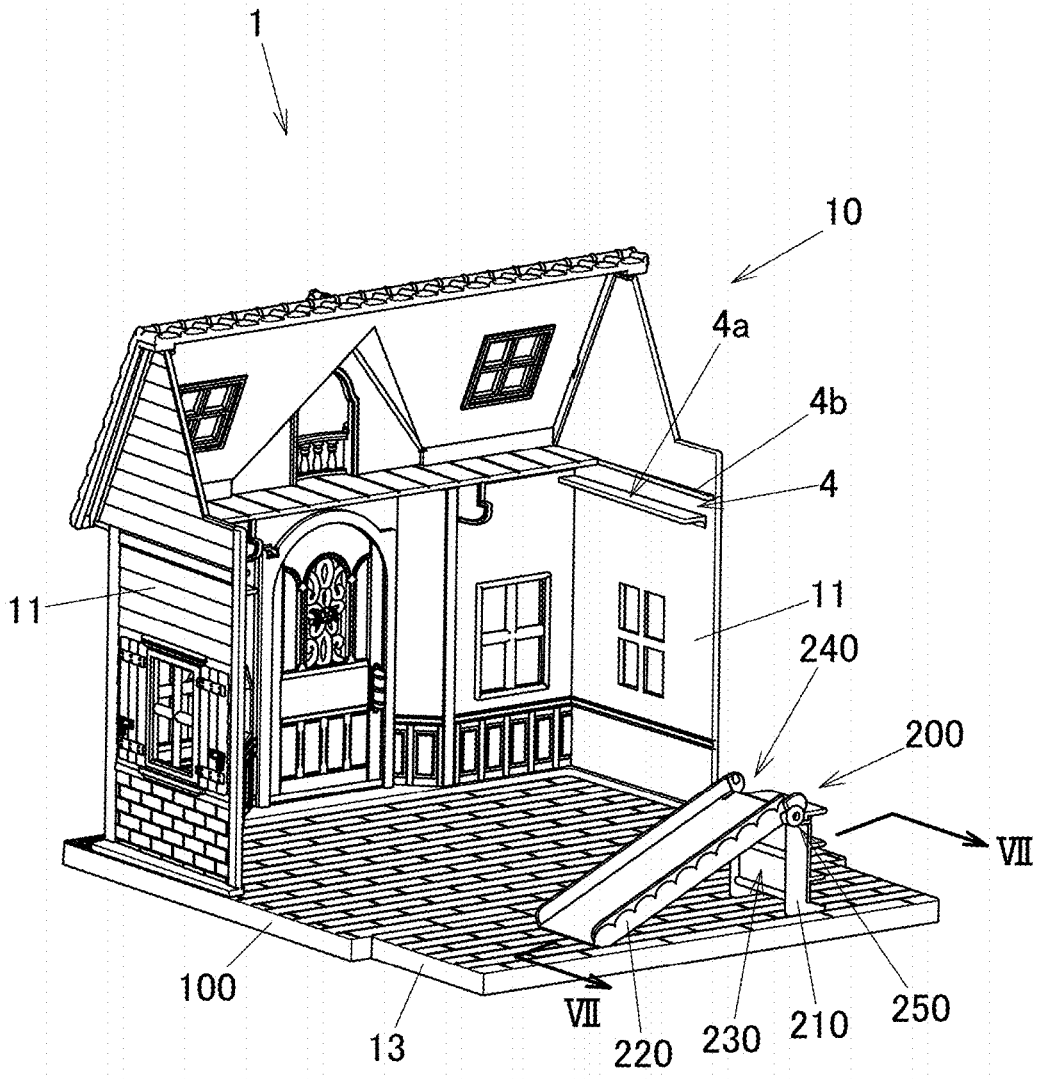
FIG. 6 is a perspective view showing an aspect in which the combined climbing toy and toy slide for a toy house according to the embodiment of the present disclosure is used as a toy slide.
Figure 7:
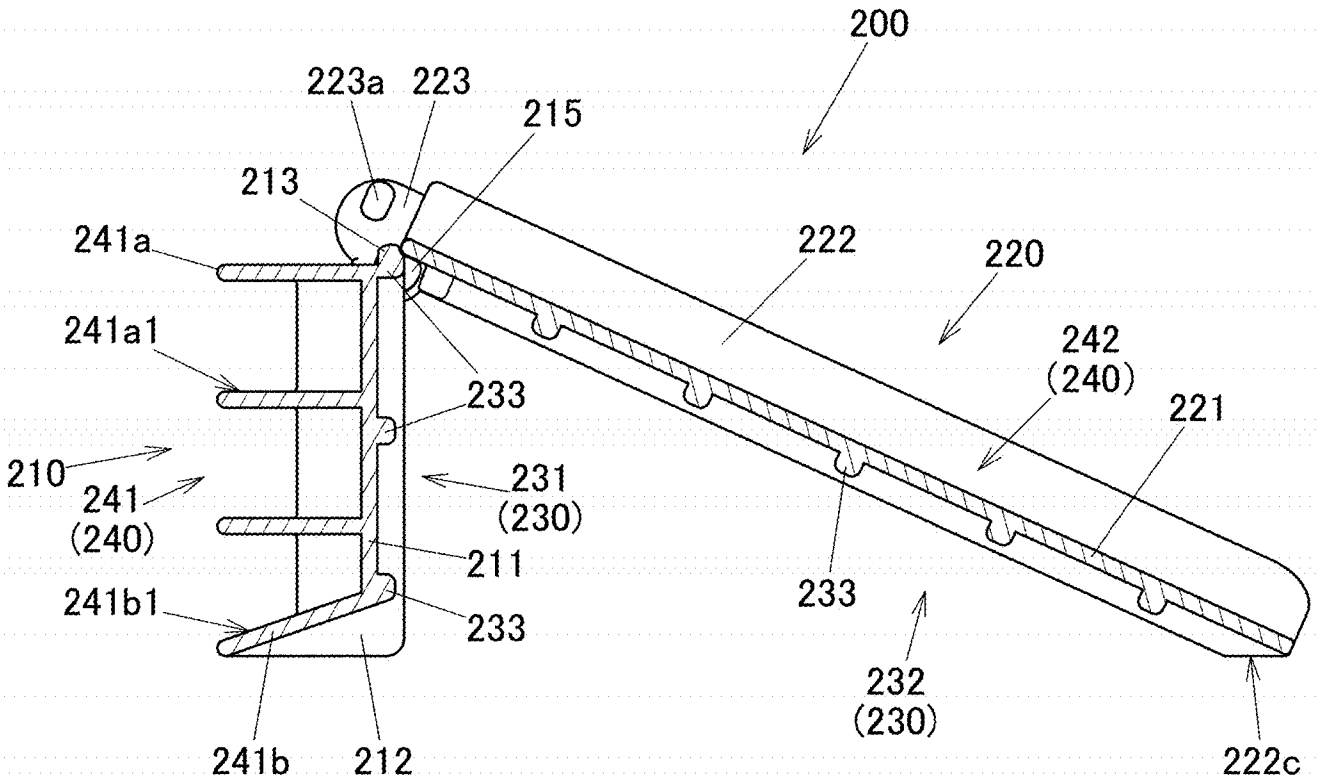
FIG. 7 is a cross-sectional view taken along line VII-VII of FIG. 6, showing the aspect in which the combined climbing toy and toy slide for a toy house according to the embodiment of the present disclosure is used as a toy slide.

The step surface 241*b*1 of the lateral plate 241*b* located at an end portion of the first member 210 serves as a first-step stepping surface when installed as a toy slide (see FIGS. 6 and 7). The step surface 241*b*1 is provided at an angle with respect to the step surface 241*a*1 of another lateral plates 241*a* so as to descend from the main plate member 211 toward an end portion of the lateral plate 241*b*. In other words, the lateral plate 241*b* is inclined to expand with respect to another lateral plate 241*a* from the main plate member 211 toward the end portion of the lateral plate 241*b* (the end portion on the slide surface 240 side).

In addition, as shown in FIG. 2, an end portion of the lateral plate 241*b* on the main plate member 211 side (climbing surface 230 side) protrudes from the surface of the main plate member 211 and is formed into a projection 233. In addition, as shown in FIG. 4, first engaging portions 251 having a protrusion shaft shape protruding from the side plates 212 in the left-right direction, respectively, are provided on a side opposite to the lateral plate 241*b* in the first member 210. A bulging portion 213 bulging in an axis radial direction of the first engaging portion 251 is provided between the first engaging portions 251.

As shown in FIG. 2, with the lateral plate 241*b* as the lowermost end, the climbing surface 230 side of the lateral plate 241*a* located at the uppermost end protrudes from the main plate member 211 as a projection 233. In addition, as shown in FIG. 3, a groove 214 that is long in a direction orthogonal to the longitudinal direction of the side plate 212 is provided in an outer surface of each of the two side plates 212 near an end portion on the first engaging portion 251 side. In addition, as shown in an encircled portion P of FIG. 2, a regulation protrusion 215 is provided near an end portion of each side plate 212 on the uppermost lateral plate 241*a* side and on an edge surface on the climbing surface 230 side of each side plate 212.

As shown in FIG. 2, the climbing surface 230 of the second member 220 is a second climbing surface 232. The second climbing surface 232 is also provided with a plurality of projections 233 similar to those described above. As shown in FIG. 3, a slide surface 242 (a slide surface 242 that is the slide surface 240 in the second member 220), which constitutes a surface opposite to the second climbing surface 232 of the second member 220, is a continuous flat surface, so that a user can play while sliding a doll in doll play.

As shown in FIGS. 2 and 3, bearings 252 are provided at end portions of the two side plates 222 on the hinge portion 250 sides, respectively. The bearing 252 is formed in a substantially circular ring shape protruding from an outer surface of the side plate 222, and a hole in a central portion serves as a second engaging portion 252*a*. The first engaging portion 251 of the first member 210 is inserted into the second engaging portion 252*a* of the second member 220. In this way, the first engaging portion 251 is inserted into the second engaging portion 252*a* and is engaged in a recess-protrusion engaging manner. In other words, the hinge portion 250 has a recess-protrusion engagement configuration by the first engaging portion 251 and the second engaging portion 252*a*. That is, in the present embodiment, the recess-protrusion engagement configuration in which the first engaging portion 251 protrudes and the second engaging portion 252*a* is recessed is provided, but a recess-protrusion engagement configuration in which the first engaging portion 251 is recessed and the second engaging portion 252*a* protrudes is also possible.

Each bearing 252 is provided with a support plate 223 protruding from a side surface having a circular ring shape in a substantially triangular plate shape. Referring to FIG. 3, a protrusion 223*a* is provided on a facing surface of each of the support plates 223 facing each other in the left-right direction (the longitudinal direction of the projection 233) (see an encircled portion Q in FIG. 3). The support plate 223 is also connected to the side plate 222. The support plate 223 is arranged outside the side plate 212 of the first member 210.

A slit S1 of a predetermined length is provided between the main plate member 221 on the hinge portion 250 side and each side plate 222. Note that a thickness of the side plate 222 is provided to be thick on the climbing surface 230 in conformity to the projection 233 (see FIG. 2) and is provided on the slide surface 240 (242) to be thinner than the thickness on the climbing surface 230 side.

As shown in the encircled portion P of FIG. 2, an end portion on the hinge portion 250 side of each side plate 222 is formed in a notch shape, and is provided with a regulation contact surface 222*a* as a flat surface perpendicular to the outer and inner surfaces (plate surfaces) of the side plate 222. Additionally, a reinforcing protrusion 222*b* extending outward from the notch portion is connected to the bearing 252 and reinforces the connection between the bearing 252 and the side plate 222.

When the accessory toy 200 is used as a climbing toy, such as a ladder, an opening angle between the first member 210 and the second member 220 is set to approximately 180 degrees so that the climbing surface 230 is continuous. In this case, as shown in FIG. 3, the step surface 241*a*1 of the lateral plate 241*a* on the hinge portion 250 side is in contact with the end surface of the slide surface 242 of the second member 220, so that the opening angle between the first member 210 and the second member 220 in the opening direction is regulated. Additionally, the protrusion 223*a* of the support plate 223 of the second member 220 is inserted into and engaged with the groove 214 of the side plate 212 of the first member 210. As a result, movement of the first member 210 and the second member 220 in the direction away from each other is regulated.

Figure 5:
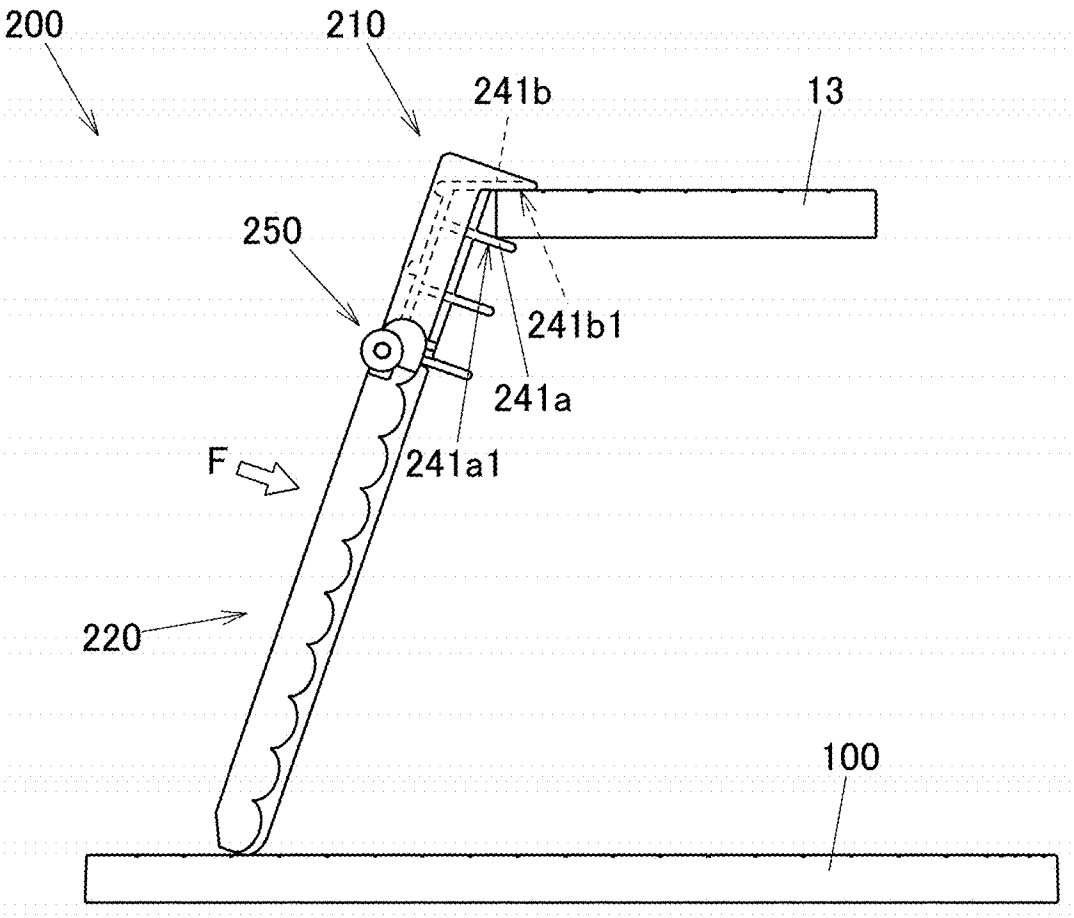
FIG. 5 is a side view showing an aspect in which the combined climbing toy and toy slide for a toy house according to the embodiment of the present disclosure is engaged with a floor member and used as a climbing toy.

As shown in FIG. 5, the accessory toy 200, which is configured as a climbing toy, can be installed such that the step surface 241*b*1 of the lateral plate 241*b* comes into contact with the upper surface of the floor member 13 of the second-floor portion of the toy house body 10. Since the lateral plate 241*b* is inclined, the opposite surface to the step surface 241*b*1 and the upper surface of the floor member 13 can be made substantially parallel to each other. Then, the floor member 13 is engaged so as to be sandwiched between the opposite surface to the step surface 241*a*1 of the lateral plate 241*a* adjacent to the lateral plate 241*b* and the step surface 241*b*1 of the lateral plate 241*b*. In this way, the accessory toy 200 is formed such that the first member 210 can be engaged with the floor member 13 and the distal end portion of the second member 220 can be in contact with the base member 100. As a result, even if the force F pressing the climbing surface 230 is applied to the accessory toy 200 as the doll plays a game such as lifting a ladder, a possibility that the accessory toy 200 in a ladder state becomes perpendicular to the floor member 13 and falls over is reduced. Note that the inner dimensions of the lateral plates 241*a* and 241*b* (the dimensions from the main plate member 211 to the distal ends of the lateral plates 241*a* and 241*b*) are designed so that the accessory toy 200 in the ladder state does not become perpendicular to the floor member 13.

When using the accessory toy 200 as a toy slide, as shown in FIGS. 6 and 7, the first member 210 and the second member 220 are relatively rotated around the hinge portions 250 so that the climbing surfaces 230 of the first member 210 and the second member 220 (the first climbing surface 231 and the second climbing surface 232) come close to each other. The relative rotation of the first member 210 and the second member 220 is performed until the regulation protrusion 215 of the first member 210 comes into contact with the regulation contact surface 222*a* of the second member 220. Since an end portion of the side plate 212 of the first member 210 (an end portion on an opposite side to the hinge portion 250) has a right-angle shape when viewed from the side, the first member 210 can be arranged to stand upright with respect to the installation surface.

Here, the distal end of each side plate 222 of the second member 220 has a C-chamfered shape at a corner portion 222*c* on the climbing surface 230 side, so that the distal end of the second member 220 can be stably brought into contact with and placed on the ground surface.

Here, when relatively rotating the first member 210 and the second member 220 so that the accessory toy 200 is transformed from the state of the toy slide to the state of the toy ladder, if a foreign object such as a finger is caught between the support plate 223 near the hinge portion 250 and the side plate 212 of the first member 210, or between the end surface of the side plate 222 near the hinge portion 250 and the lateral plate 241*a* of the first member 210, a portion of each side plate 222 corresponding to the slit S1 opens outward because the end portion on the hinge portion 250 side of each side plate 222 of the second member 220 has elasticity due to the slit S1. Then, along with the outward movement of each side plate 222, the bearing 252 also moves outward, causing the first engaging portion 251 to separate from the second engaging portion 252*a*, resulting in the release of the recess-protrusion engagement between the first engaging portion 251 and the second engaging portion 252*a* and the disassembly of the first member 210 and the second member 220. Since the portion of the side plate 222 supporting the bearing 252 (the portion of the side plate 222 corresponding to the slit S1) has elasticity, the first engaging portion 251 can be easily fitted to the second engaging portion 252*a* to make the recess-protrusion engagement again.

Additionally, as shown in FIG. 6, the floor member 13 of the second-floor portion of the toy house 1 is configured to be freely attachable and detachable by guide portions 4 provided on the inner surfaces of the facing wall portions 11. Here, the guide portion 4 can enable sliding on an elongated guide surface 4*a* that is long in the front-rear direction. Additionally, the guide portion 4 is provided with a guide projection 4*b* in the left-right direction above the guide surface 4*a*. The guide projection 4*b* is shaped to fill a gap between an inner surface of each of the left and right wall portions 11 provided to expand toward the front side and a side surface of the rectangular floor member 13. If the floor member 13 is formed into a trapezoidal shape in conformity to the wall portions 11 to expand, the floor member 13 may be set on the guide portions 4 in the wrong front-rear direction and may be damaged. In the toy house 1, the floor member 13 is formed into a rectangular shape using the guide projections 4*b*. As a result, when setting the floor member 13 to the guide portions 4, the directionality of the insertion direction of the floor member 13 can be eliminated.

The floor member 13 removed from the toy house 1 can be installed on the front side of the base member 100 to expand the bottom portion of the toy house 1. Then, the accessory toy 200, which is a toy slide, can be installed on the floor of the expanded room for play.

According to the embodiment of the present disclosure as described above, a toy house of the following aspects can be provided.

A combined climbing toy and toy slide for a toy house according to a first aspect includes: a first member including a first climbing surface and a climbing surface for slide, the climbing surface constituting an opposite surface to the first climbing surface; and a second member including a second climbing surface and a slide surface, the slide surface constituting an opposite surface to the second climbing surface, the second member being rotatably connected to the first member via a hinge portion such that the first climbing surface and the second climbing surface are connectable.

According to this configuration, for example, when playing with the combined climbing toy and toy slide for a toy house as a climbing toy for a toy house, such as a toy ladder or a toy stair, the first climbing surface of the first member and the second climbing surface of the second member are used, and when playing with the combined climbing toy and toy slide for a toy house as a toy slide, the climbing surface for a slide of the first member, which serves as a climbing portion of a toy slide such as step stairs, and the slide surface of the second member can be used. Therefore, it is possible to provide a combined climbing toy and toy slide for a toy house, which can be transformed from a climbing toy into a toy slide.

In the combined climbing toy and toy slide for a toy house according to a second aspect, the hinge portion has a recess-protrusion engagement configuration by a first engaging portion provided on the first member and a second engaging portion provided on the second member, and the first engaging portion or the second engaging portion is provided on the first member or the second member via a slit.

According to this configuration, elastic force is provided on the first engaging portion or the second engaging portion by the slit. Therefore, even if a foreign object or the like is caught between the first member and the second member, the damage due to the caught foreign object or the like can be reduced by releasing the recess-protrusion engagement between the first engaging portion and the second engaging portion. Note that, in the present embodiment, the recess-protrusion engagement configuration in which the first engaging portion protrudes and the second engaging portion is recessed is provided, but a recess-protrusion engagement configuration in which the first engaging portion is recessed and the second engaging portion protrudes is also possible. Furthermore, in the present embodiment, the second engaging portion is provided via the slit, but the first engaging portion may be provided via the slit.

In the combined climbing toy and toy slide for a toy house according to a third aspect, the climbing surface for slide is formed in a shape of step stairs with a plurality of lateral plates, and a step surface of a first step is inclined.

According to this configuration, when playing with the combined climbing toy and toy slide for a toy house as a toy slide, as a toy ladder, even if the toy ladder is leaned against a floor member constituting a second-floor portion of the toy house, a surface opposite to the step surface of the first step can be made approximately parallel to an upper surface of the floor member. Therefore, it is possible to provide a combined climbing toy and toy slide for a toy house with good appearance.

In the combined climbing toy and toy slide for a toy house according to a fourth aspect, the first climbing surface and the second climbing surface are formed to imitate a ladder.

According to this configuration, the combined climbing toy and toy slide for a toy house can be used as a toy ladder among climbing toys.

A toy house according to a fifth aspect includes: the combined climbing toy and toy slide for a toy house according to any one of the above-described aspects; a toy house body having an open front side, the toy house body including a floor member that is detachable, the floor member constituting an upper layer stair including at least a second-floor portion; and a base member, in which the combined climbing toy and toy slide for the toy house is formed such that the first member is configured to engage the floor member and the second member is configured to contact the base member.

According to this configuration, the floor member of the second-floor portion can be freely attached to and detached from a toy house, so when using the combined climbing toy and toy slide for a toy house as a toy ladder, the combined climbing toy and toy slide for a toy house and the floor member can be engaged for play. In addition, by arranging the removed floor member in line with the base member, the toy slide can be placed on the floor portion of the expanded room when playing with the combined climbing toy and toy slide for a toy house as a toy slide.

Although the embodiments of the present disclosure have been described, the present disclosure is not limited to the above-described embodiments and can be variously changed without departing from the scope.

What is claimed is:

1. A combined climbing toy and toy slide for a toy house comprising:

a first member comprising a first climbing surface and a climbing surface for slide, the climbing surface constituting an opposite surface to the first climbing surface; and a second member comprising a second climbing surface and a slide surface, the slide surface constituting an opposite surface to the second climbing surface, the second member being rotatably connected to the first member via a hinge portion such that the first climbing surface and the second climbing surface are connectable.

2. The combined climbing toy and toy slide for the toy house according to claim 1, wherein the hinge portion has a recess-protrusion engagement configuration by a first engaging portion provided on the first member and a second engaging portion provided on the second member, and wherein the first engaging portion or the second engaging portion is provided on the first member or the second member via a slit.

3. The combined climbing toy and toy slide for the toy house according to claim 1, wherein the climbing surface for slide is formed in a shape of step stairs with a plurality of lateral plates, and a step surface of a first step is inclined.

4. The combined climbing toy and toy slide for the toy house according to claim 1, wherein the first climbing surface and the second climbing surface are formed to imitate a ladder.

5. A toy house comprising:

the combined climbing toy and toy slide for the toy house according to claim 1;

a toy house body having an open front side, the toy house body comprising a floor member that is detachable, the floor member constituting an upper layer stair including at least a second-floor portion; and a base member, wherein the combined climbing toy and toy slide for the toy house is formed such that the first member is configured to engage the floor member and the second member is configured to contact the base member.

* * * * *